US008929795B2

(12) United States Patent
Inami

(10) Patent No.: US 8,929,795 B2
(45) Date of Patent: Jan. 6, 2015

(54) CLEANING DEVICE, PROCESS CARTRIDGE AND IMAGE FORMING APPARATUS

(71) Applicant: Canon Kabushiki Kaisha, Tokyo (JP)

(72) Inventor: Satoru Inami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 13/727,828

(22) Filed: Dec. 27, 2012

(65) Prior Publication Data

US 2013/0216287 A1 Aug. 22, 2013

(30) Foreign Application Priority Data

Feb. 20, 2012 (JP) ..... 2012-033748

(51) Int. Cl.
*G03G 21/00* (2006.01)
*G03G 15/095* (2006.01)

(52) U.S. Cl.
CPC ..... *G03G 15/095* (2013.01); *G03G 21/0029* (2013.01)
USPC ..... 399/351

(58) Field of Classification Search
USPC ..... 399/351, 350, 123, 284; 15/256.5, 15/256.51, 256.52
See application file for complete search history.

(56) References Cited

U.S. PATENT DOCUMENTS

| | | | | |
|---|---|---|---|---|
| 5,470,635 | A | 11/1995 | Shirai et al. | |
| 5,646,718 | A | 7/1997 | Suwa et al. | |
| 5,995,785 | A | 11/1999 | Kato et al. | |
| 2005/0238395 | A1 * | 10/2005 | Ueno et al. | 399/350 |
| 2013/0071164 | A1 * | 3/2013 | Sunahara | 399/350 |
| 2013/0108321 | A1 * | 5/2013 | Uyama | 399/123 |

* cited by examiner

*Primary Examiner* — Sophia S Chen
(74) *Attorney, Agent, or Firm* — Fitzpatrick, Cella, Harper & Scinto

(57) ABSTRACT

A cleaning device for use with an image forming apparatus, includes: a frame including a fixing portion; a cleaning member, fixed at the fixing portion, for removing developer from an image bearing member (drum). The cleaning member includes: a blade portion contacted to the drum; and a flexible supporting member for supporting the blade portion, the supporting member including one end portion where the blade portion is provided, another end portion including a portion-to-be-fixed at the fixing portion, and a bent portion between the end portions; and an engaging portion provided on the frame. The engaging portion is engaged, such that the blade portion is not contacted to the drum, with a portion-to-be-engaged provided at the supporting member to position the cleaning member. The engaging portion is spaced from the portion-to-be-engaged in a state in which the blade portion is contacted to the drum.

21 Claims, 9 Drawing Sheets

CLEANING DEVICE, PROCESS CARTRIDGE AND IMAGE FORMING APPARATUS

FIELD OF THE INVENTION AND RELATED ART

The present invention relates to an electrophotographic image forming apparatus such as a copying machine, a laser beam printer or a facsimile machine, and relates to a cleaning device or use with the image forming apparatus, and a process cartridge.

In the electrophotographic image forming apparatus, a cleaning blade type as a cleaning means for removing, in order to repetitively use the image bearing member, the developer remaining on the image bearing member after transferring a developer image from the image bearing member onto a recording material (medium) has been known.

The cleaning type is a method in which a blade having elasticity is contacted to the surface of the image bearing member at a predetermined pressure to remove the developer from the surface of the image bearing member.

In U.S. Pat. No. 5,470,635, the cleaning member has a structure in which a blade is mounted by molding at an end of a metal plate as a supporting member. Further, the metal plate is secured to a frame by a screw or the like to fix the cleaning member, so that the cleaning member is contacted to the surface of the image bearing member at the predetermined pressure.

However, the image forming apparatus such as the printer tends to be downsized, increased in speed and improved in image quality with popularization thereof. When the image forming apparatus is downsized, a size of the image bearing member becomes small. Further, by the speed-up, the image bearing member is quickly rotated. That is, the blade contacted to the image bearing member surface repetitively slides on the image bearing member surface at high speed. Then, a temperature of the blade itself is increased, so that hardness of the blade is decreased. As a result, a frictional force between the image bearing member surface and the blade is increased. Thus, there can arise a problem of an increase in driving torque for driving the image bearing member and turning-up of the blade. Further, in recent years, a spherical developer is used in order to improve the image quality. In this case, in order to remove the developer from the image bearing member surface, there is a need to increase a contact pressure of the blade to the image bearing member, thus constituting one of factors which accelerate the above-described problem.

SUMMARY OF THE INVENTION

The present invention has been accomplished in order to solve the above-described problem of the prior art. A principal object of the present invention is to provide a cleaning device, a process cartridge and an image forming apparatus which are capable of suppressing an increase in driving torque and turning-up of a blade when an image bearing member is driven.

Another object of the present invention is to provide a cleaning device, a process cartridge and an image forming apparatus which permit easy assembling of a cleaning member with a frame and easy ensuring of positional accuracy of the blade relative to the image bearing member.

According to an aspect of the present invention, there is provided a cleaning device for use with an image forming apparatus, comprising: a frame including a fixing portion; a cleaning member, fixed at the fixing portion, for removing a developer from an image bearing member, wherein the cleaning member includes: a blade portion contacted to the image bearing member with respect to a counter direction to a movement direction of the image bearing member; and a flexible supporting member for supporting the blade portion, the supporting member including one end portion where the blade portion is provided, another end portion including a portion-to-be-fixed for being fixed at the fixing portion, and a bent portion between the one end portion and the another end portion in a side remote from a surface of the image bearing member toward an outside with respect to a line connecting the portion-to-be-fixed and a contact portion where the blade portion is contacted to the image bearing member, wherein the portion-to-be-fixed is provided downstream of the contact portion with respect to movement direction of the image bearing member; and an engaging portion provided on the frame, wherein the engaging portion is engaged, in a state in which the blade portion is not contacted to the image bearing member, with a portion-to-be-engaged provided at the supporting member to position the cleaning member, and wherein the engaging portion is spaced from the portion-to-be-engaged in a state in which the blade portion is contacted to the image bearing member.

According to another aspect of the present invention, there is provided a process cartridge detachably mountable to an image forming apparatus, comprising: (i) an image bearing member; (ii) a frame including a fixing portion; (iii) a cleaning member, fixed at the fixing portion, for removing a developer from the image bearing member, wherein the cleaning member includes: a blade portion contacted to the image bearing member with respect to a counter direction to a movement direction of the image bearing member; and a flexible supporting member for supporting the blade portion, the supporting member including one end portion where the blade portion is provided, another end portion including a portion-to-be-fixed for being fixed at the fixing portion, and a bent portion between the one end portion and the another end portion in a side remote from a surface of the image bearing member toward an outside with respect to a line connecting the portion-to-be-fixed and a contact portion where the blade portion is contacted to the image bearing member, wherein the portion-to-be-fixed is provided downstream of the contact portion with respect to movement direction of the image bearing member; and (iv) an engaging portion provided on the frame, wherein the engaging portion is engaged, in a state in which the blade portion is not contacted to the image bearing member, with a portion-to-be-engaged provided at the supporting member to position the cleaning member, and wherein the engaging portion is spaced from the portion-to-be-engaged in a state in which the blade portion is contacted to the image bearing member.

According to a further aspect of the present invention, there is provided an image forming apparatus for forming an image on a recording material, comprising: (i) an image bearing member; (ii) a frame including a fixing portion; (iii) a cleaning member, fixed at the fixing portion, for removing a developer from the image bearing member, wherein the cleaning member includes: a blade portion contacted to the image bearing member with respect to a counter direction to a movement direction of the image bearing member; and a flexible supporting member for supporting the blade portion, the supporting member including one end portion where the blade portion is provided, another end portion including a portion-to-be-fixed for being fixed at the fixing portion, and a bent portion between the one end portion and the another end portion in a side remote from a surface of the image bearing member toward an outside with respect to a line connecting the portion-to-be-fixed and a contact portion where the blade portion is contacted to the image bearing member, wherein the portion-to-be-fixed is provided downstream of the contact portion with respect to movement direction of the image bearing member; and (iv) an engaging portion provided on the frame, wherein the engaging portion is engaged, in a state in which the blade portion is not contacted to the image bearing member, with a portion-to-be-engaged provided at the supporting member to position the cleaning member, and wherein the engaging portion is spaced from the portion-to-be-engaged in a state in which the blade portion is contacted to the image bearing member.

These and other objects, features and advantages of the present invention will become more apparent upon a consideration of the following description of the preferred embodiments of the present invention taken in conjunction with the accompanying drawings.

Figure 6:
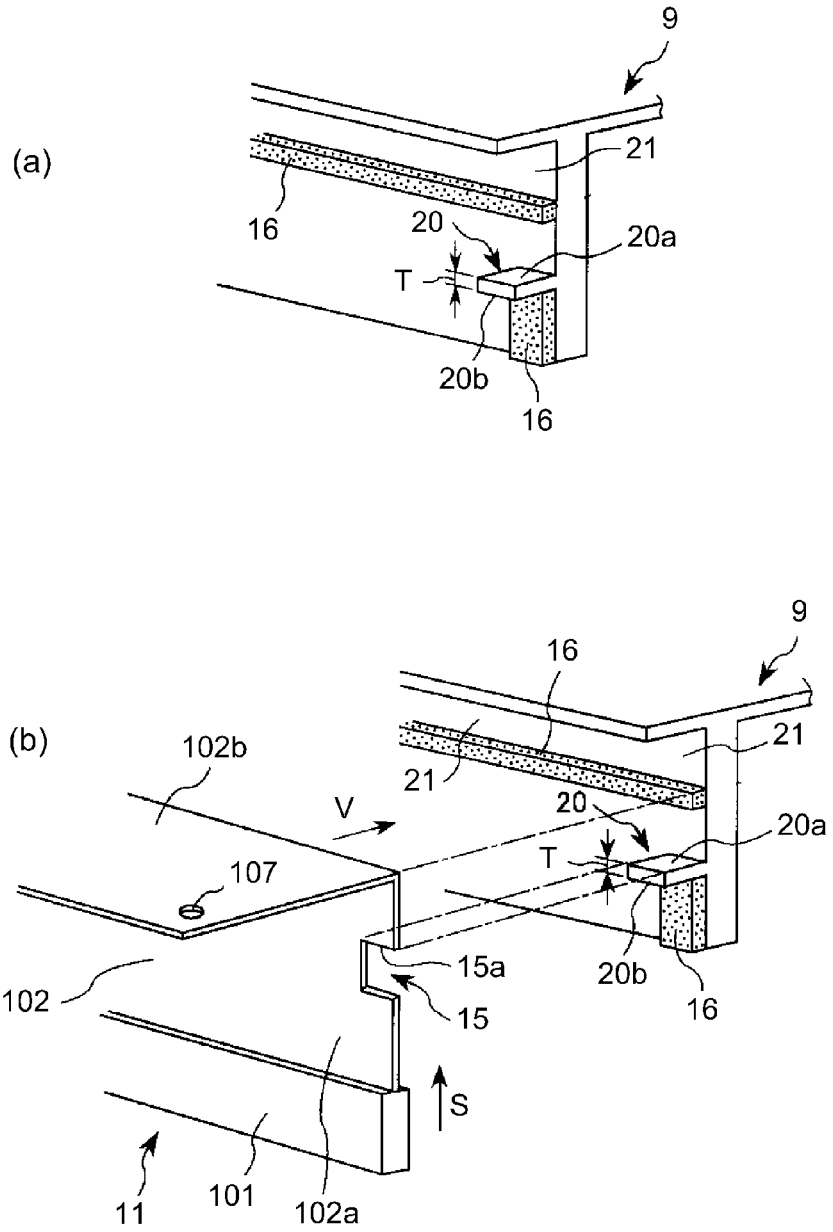

Part (a) of FIG. 6 is a perspective view of a positioning portion of a cleaning container where the cleaning member is to be mounted, and (b) of FIG. 6 is a perspective view for illustrating a mounting operation of the cleaning member to the cleaning container.

Figure 7:
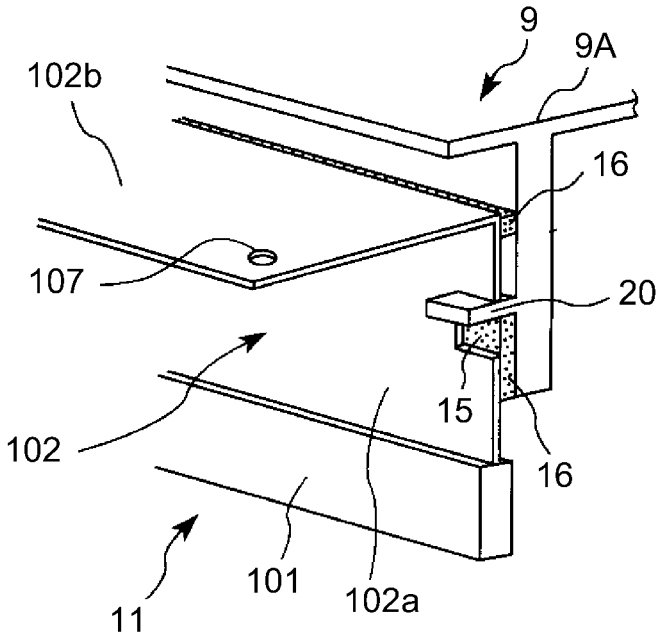

FIG. 7 is a perspective view when the cleaning member is mounted to the cleaning container.

Figure 8:
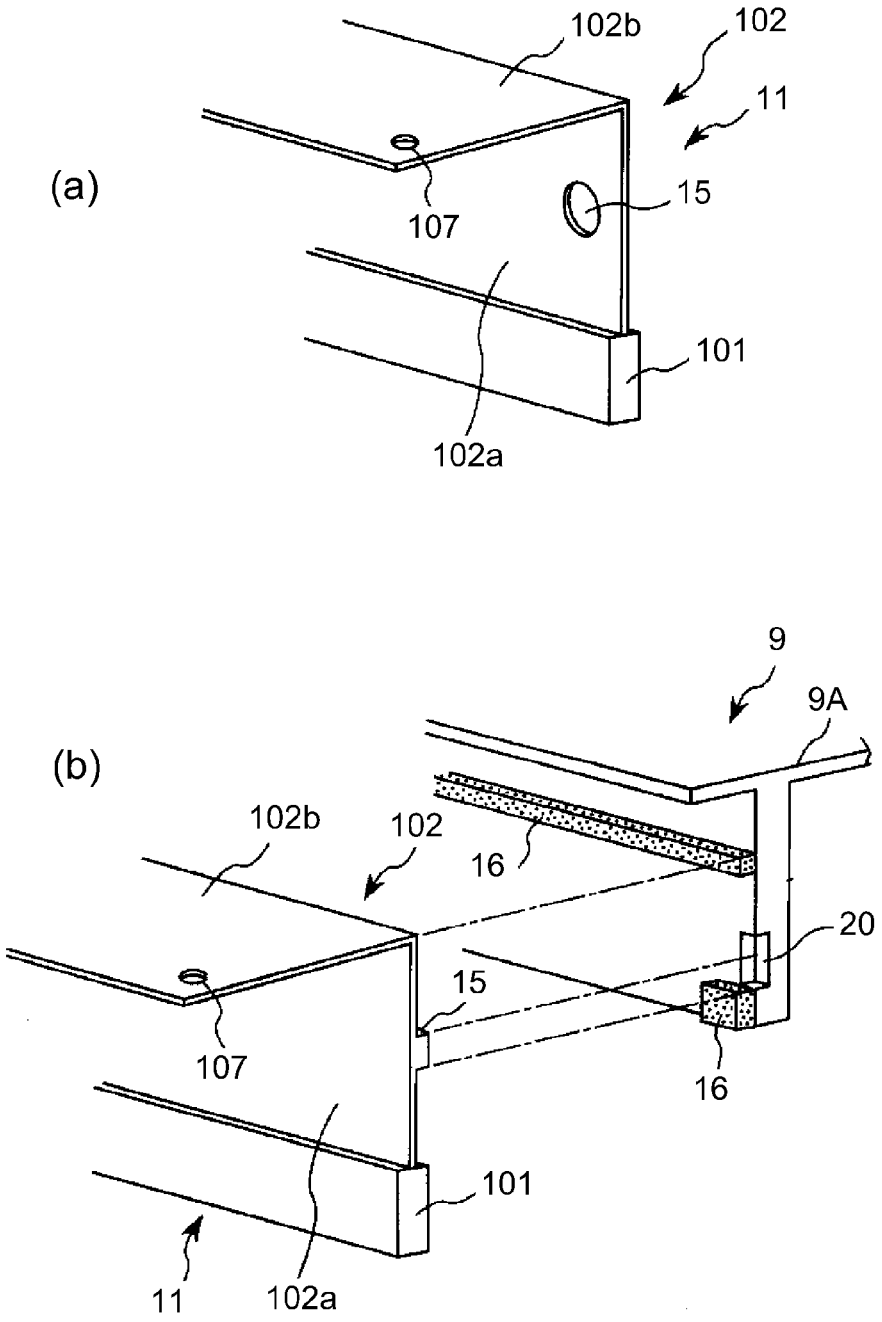

Part (a) of FIG. 8 is a perspective view showing a shape for positioning a cleaning member in another embodiment, and (b) of FIG. 8 is a perspective view for illustrating a mounting operation of a cleaning member in another embodiment.

Figure 9:
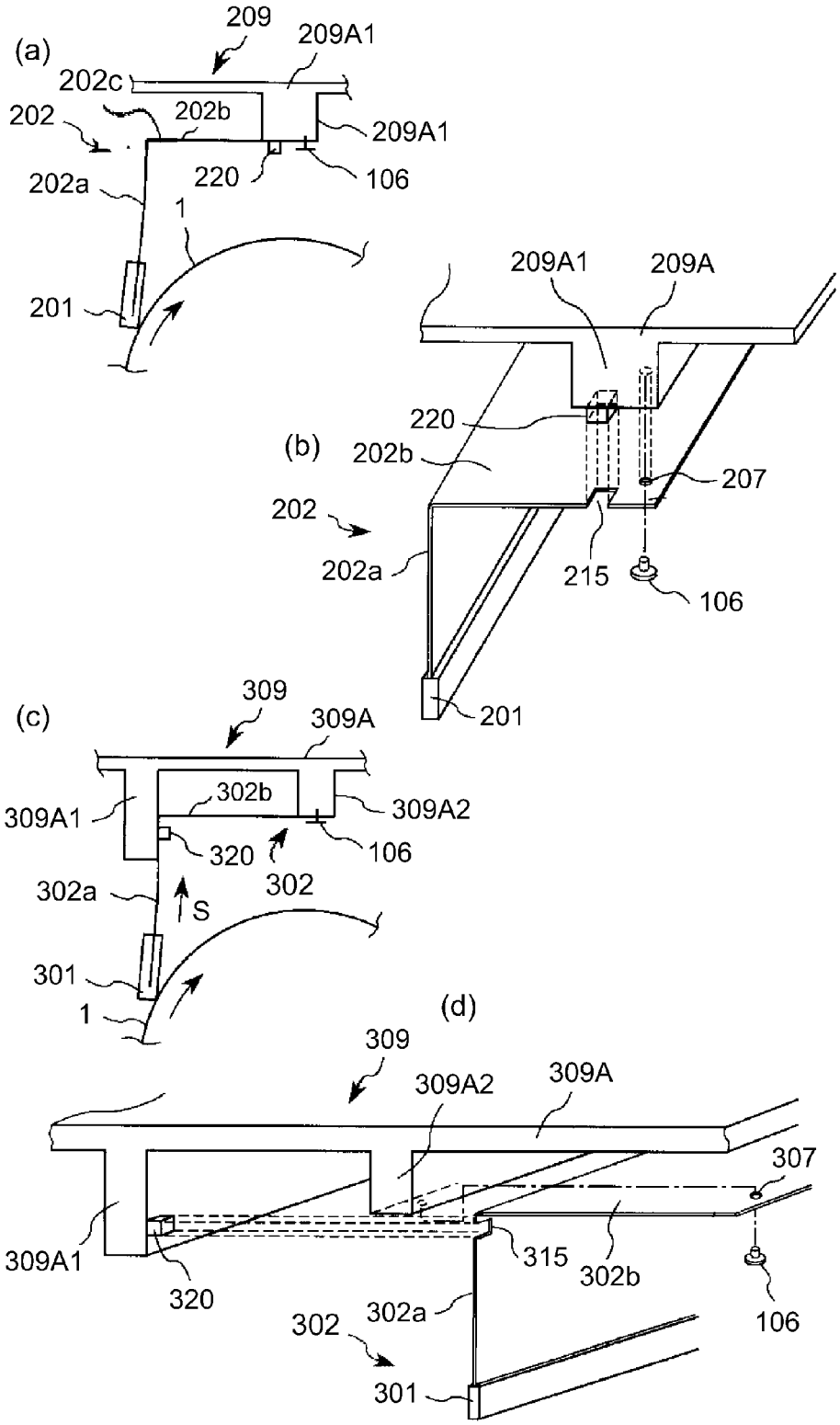

Part (a) of FIG. 9 is a schematic view in the case where positioning is made in the neighborhood of a cleaning member downstream end, (b) of FIG. 9 is a perspective view for illustrating a mounting operation in the case where positioning is made in the neighborhood of the cleaning member downstream end, (c) of FIG. 9 is a schematic view in the case where positioning is made in the neighborhood of a bent portion of the cleaning member, and (d) of FIG. 9 is a perspective view for illustrating a mounting operation in the case where positioning is made in the neighborhood of the bent portion of the cleaning member.

Figure 10:
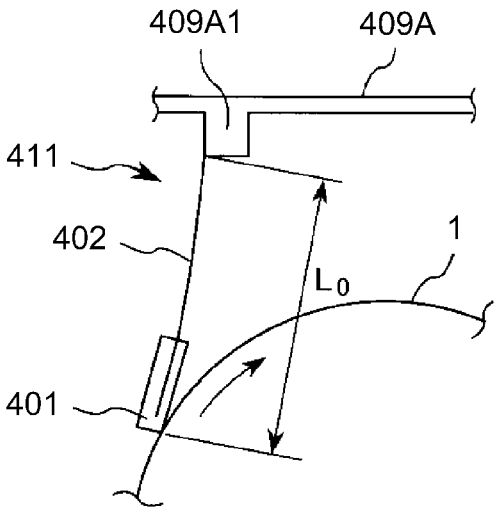

FIG. 10 is a schematic view of a cleaning member in a comparative embodiment.

DESCRIPTION OF THE PREFERRED EMBODIMENTS

A cleaning device, a process cartridge and an image forming apparatus in an embodiment of the present invention will be described specifically with reference to the drawings.

First, a general structure and operation of the image forming apparatus will be described.

Figure 1:
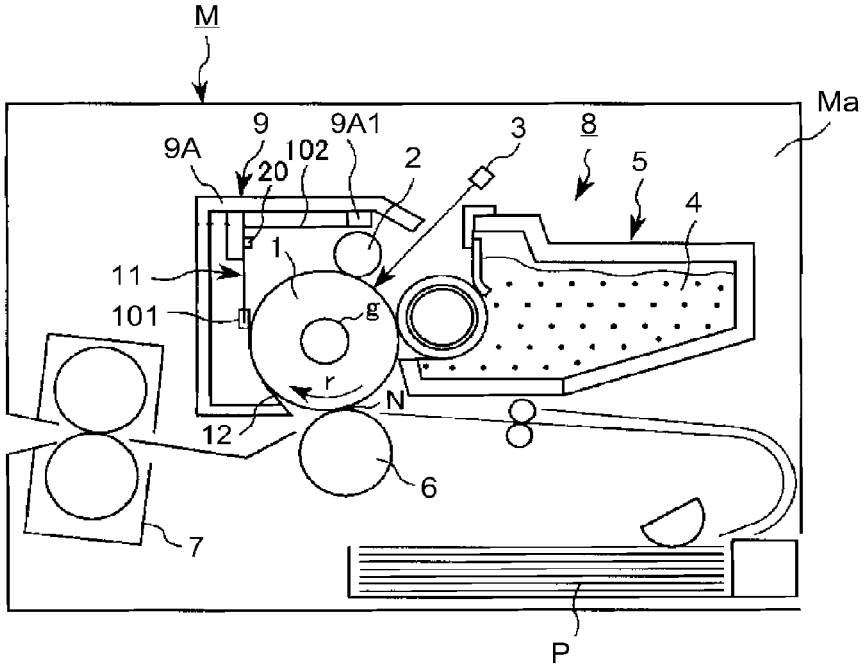
FIG. 1 is a schematic sectional view of an image forming apparatus in an embodiment.

The image forming apparatus M, according to the present invention, shown in FIG. 1 is a monochromatic laser beam printer of an electrophotographic type, and FIG. 1 is a schematic longitudinal sectional view of the image forming apparatus.

In this embodiment, at a substantially central portion of a main assembly Ma of the image forming apparatus M, a drum-type electrophotographic photosensitive member (photosensitive drum) 1 as an image bearing member is provided. The photosensitive drum 1 is prepared by forming an OPC (organic photoconductor (optical semiconductor)) photosensitive layer on an outer peripheral surface of an electroconductive drum support of aluminum or the like. The photosensitive drum 1 is rotationally driven about a shaft g in an arrow r direction at a predetermined process speed (peripheral speed) of 200 mm/sec.

The surface (peripheral surface) of the photosensitive drum 1 is electrically charged uniformly to a predetermined polarity and a predetermined potential by a charging roller 2 as a charging means. The surface of the photosensitive drum 1 after the charging is subjected to scanning exposure to a laser beam outputted from a laser beam scanner 3 as an exposure means, so that an electrostatic latent image is formed. This laser beam is modulated correspondingly to a time-series electric digital pixel signal of objective image information, so that the electrostatic latent image corresponding to the objective image information is formed. On this electrostatic latent image, a developer (toner) 4 conveyed by a developing device 5 as a developing means is deposited, so that the latent image is developed as a toner image.

On the other hand, a recording material P is fed by a sheet feeding roller and is sent to a transfer nip N between the photosensitive drum 1 and a transfer roller (transfer means) 6 so as to be synchronized with the toner image formed on the photosensitive drum 1. At the transfer nip N, the toner image is transferred onto the surface of the recording material P. To the transfer roller 6, a transfer bias for transfer is applied from a transfer bias applying power (voltage) source during the transfer.

The recording material P subjected to the toner image transfer is separated from the surface of the photosensitive drum 1 and then is conveyed to a fixing device 7, where the toner image is heated and pressed to be fixed on the surface of the recording material P.

On the other hand, the photosensitive drum 1 after the toner image transfer is subjected to removal of a residual toner, remaining on the surface thereof without being transferred onto the recording material P, by a cleaning member 11 of a cleaning device disposed outside the outer peripheral surface of the photosensitive drum 1, and then is subjected to subsequent image formation.

In this embodiment, four process devices consisting of the photosensitive drum 1, the charging roller 2, the developing device 5 and the cleaning device 9 are integrally assembled with a cartridge frame (not shown) to constitute a process cartridge 8 which is replaceable and is detachably mountable to the apparatus main assembly Ma. Thus, the process cartridge 8 can be demountable from and mountable to the apparatus main assembly Ma of the image forming apparatus M.

The cleaning member 11 is contacted to the photosensitive drum 1 counterdirectionally to the movement direction r of the photosensitive drum 1 as shown in FIG. 1. The cleaning member 11 enters and contacts the surface of the photosensitive drum 1 and scrapes off the residual toner by an urging force generated by repulsion of the photosensitive drum 1.

[Cleaning Device]

Figure 2:
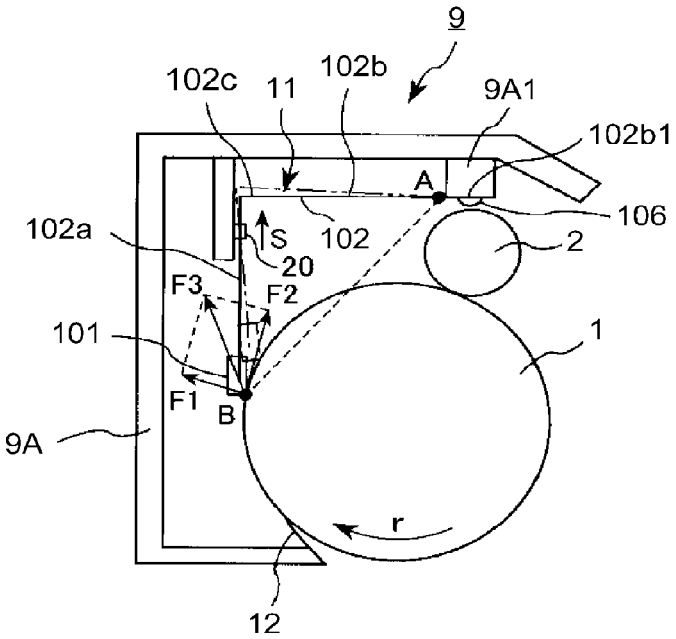
FIG. 2 is a schematic view showing a cleaning device.

With reference to FIG. 2, the structure of the cleaning device 9 will be further described.

The cleaning device 9 is, as shown in FIG. 2, constituted by the cleaning member 11, a receptor sheet 12 and a cleaning container 9A as a frame. A blade portion 101 of the cleaning member 11 is contacted to the photosensitive drum 1 counterdirectionally to the movement direction r of the photosensitive drum 1 to scrape off the toner from the surface of the photosensitive drum 1. The scraped toner is located at a lower portion of the cleaning member 11 and is scooped by the receptor sheet 12 contacted to the surface of the photosensitive drum 1. Then, the scooped toner is stored in the cleaning container 9A.

In this embodiment, as shown in FIG. 2, the cleaning member 11 is prepared by mounting the blade portion 101 of a rubber member as an elastic member on a flexible supporting member 102 constituted by a leaf spring at an end portion 102*a*. The supporting member 102 includes the end portion 102*a* where the blade portion is mounted, and includes another end portion 102*b* opposite from the end portion 102*a*. Further, the another end portion 102*b* includes a portion-to-be-fixed 102*b*1 to be fixed on a fixing portion 9A1 of the cleaning container 9A with a screw 106. Further, when the cleaning member 11 is mounted to the cleaning container 9A, the end portion 102*a* is located in an upstream side with respect to a rotational direction of the photosensitive drum 1, and the another end portion 102*b* is located in a downstream side with respect to the rotational direction 1. Further, the supporting member 102 includes a bent portion 102*c* between the end portion 102*a* and the another end portion 102*b* in a side remote from the surface of the photosensitive drum 1 toward an outside with respect to a line (segment) AB connecting A as the portion-to-be-fixed 102*b*1 and a contact portion B where the blade portion 101 is contacted to the photosensitive drum 1.

By employing such a constitution, when the photosensitive drum 1 is rotated, the blade portion 101 receives a force of resultant force F3 which is resultant force between resistance F1 by the contact pressure of the supporting member 102 and frictional force F2 between the surface of the photosensitive drum 1 and the blade portion 101. With respect to this resultant force F3, the end portion 102*a* has a small angle formed between itself and the resultant force F3 and therefore a degree of freedom of deformation is very small, so that the end portion 102*a* is not readily deformed (i.e., thrusts). On the other hand, with respect to a direction of the resultant force F3, the another end portion 102*b* has a large angle formed between itself and the resultant force F3 and therefore the degree of freedom of deformation is high. Therefore, as indicated by a broken line in FIG. 2, the another end portion 102*b* is deformable. Further, the another end portion 102*b* can be deformed with respect to an arrow S direction in FIG. 2, so that the blade portion 101 supported by the supporting member 102 is prevented from entering the photosensitive drum 1. As a result, the increase in reaction F1 is suppressed. For this reason, the increase in driving torque for driving the photosensitive drum 1 and the turning-up of the blade portion 101 can be suppressed. Detailed data will be described later.

Figure 3:
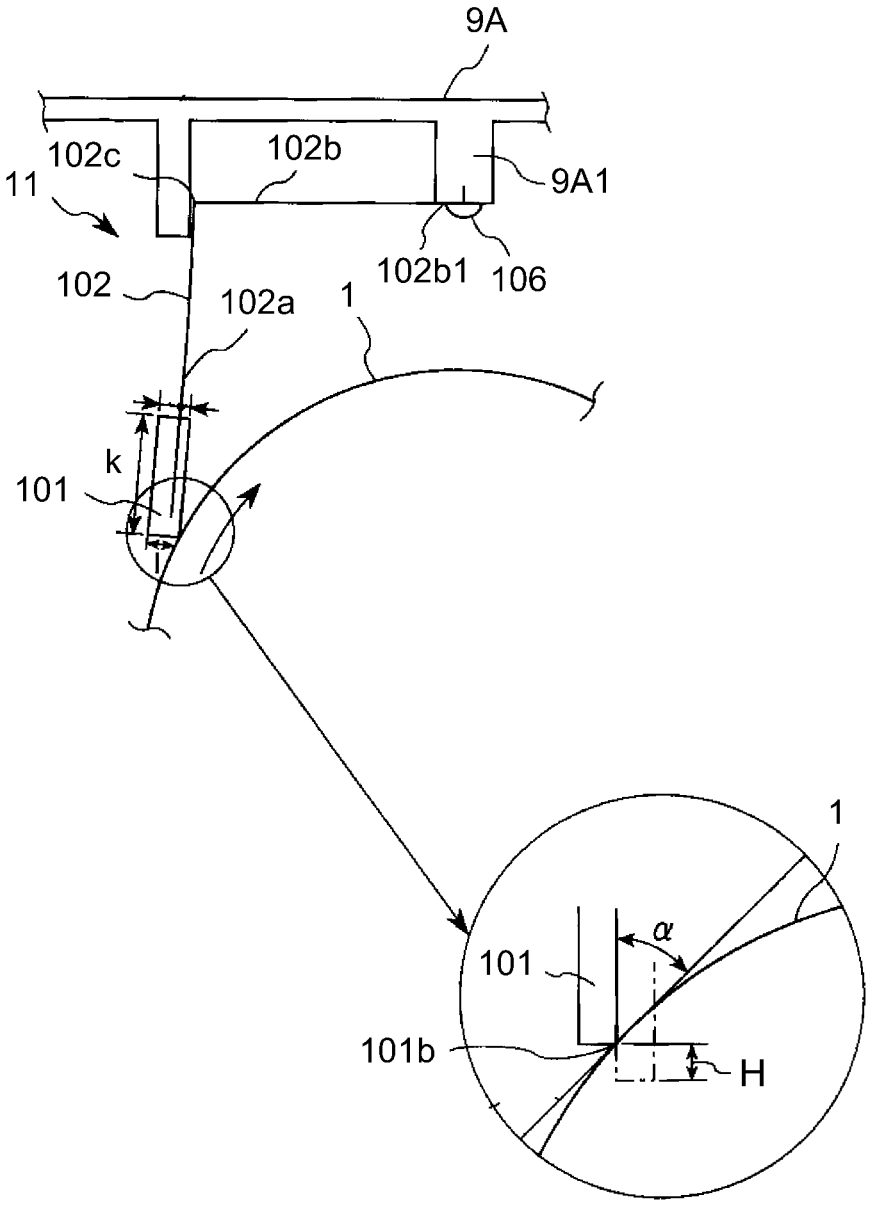
FIG. 3 is a schematic view for illustrating a constitution of the cleaning device and a set angle of a blade portion.

As the supporting member 102, a 0.2 mm-thick plate-like spring member of SUS304 (Young's modulus: 167000 MPa) was used. The plate-like spring member was subjected to bending of about 90 degrees uniformly with respect to a rotational axis direction of the photosensitive drum 1. In this case, a length of the another end portion 102*b* of the supporting member 102 was 12 mm, and a distance from the end portion 102*a* of the supporting member 102 to an end of the blade portion 101 was 12 mm. As the plate-like spring member, it is possible to use, e.g., a phosphor bronze plate or another member having a spring characteristic. Further, in place of the plate-like spring member, a resin member having elasticity can be used. Further, the blade portion 101 was formed with urethane rubber which is an elastic member, and the urethane rubber member having JIS-A hardness of 70 degrees was used. A shape of the blade portion is as shown in FIG. 3, and in order to reduce a degree of the influence of deformation of the end, the blade portion 101 had a cross section of 3.0 mm in length k, 2.0 mm in width l, 1.0 mm in widthwise length from the supporting member, and 1.0 mm in remaining widthwise length from the supporting member and was subjected to evaluation. As a bonding method between the supporting member 102 and the blade portion 101, other than molding, it is also possible to use a method using a double-sided tape or a hot-melt adhesive.

In a state in which the blade portion 101 does not contact the photosensitive drum 1, the blade portion 101 is in a state indicated by a chain line in FIG. 3. Then, when the blade portion 101 is contacted to the photosensitive drum 1, the state is changed to a state indicated by a solid line in FIG. 3. In this state, a penetration depth (entering amount) of the blade portion 101 is H, and an edge portion 101*b* is contacted to the photosensitive drum 1 at a set angle $\alpha$ of 30 degrees. Here, contact pressure was about 40 gf per cm with respect to the rotational axis direction of the photosensitive drum 1. For comparison, when checking was made at the set angle $\alpha$ of 20 degrees, the contact pressure was about 35 gf per cm with respect to the rotational axis direction of the photosensitive drum 1. At this time, a friction coefficient $\mu$between the blade portion 101 and the photosensitive drum 1 was 1.0.

[Change in Contact Pressure]

A change in contact pressure of the cleaning member 11 with respect to a dynamic friction coefficient between the photosensitive drum 1 and the blade portion 101 will be described with respect to the cleaning member 11 in this embodiment.

In order to show a performance of the cleaning member 11 in this embodiment, comparison was made between the cleaning member 11 in this embodiment and a cleaning member 411, shown in FIG. 10, having no bent portion as Comparative Embodiment 1.

In Comparative Embodiment 1, as a flexible member as a supporting member 402 of the cleaning member 411, the 0.2 mm-thick SUS plate which is the same as that used in this embodiment was used. A length L0 from a fixing portion holding member 409A1, between a cleaning container 409A and the supporting member 402, to an end of a blade portion 401 was 21.5 mm. Further, as the (end) blade portion 401, the urethane rubber member having the JIS-A hardness of 70 degrees was used, and its dimension and shape are also the same as those of the blade portion 101 in this embodiment. Similarly as in this embodiment, when the cleaning member 411 was caused to enter the photosensitive drum 1 with the set angle $\theta$ of 30 degrees and the penetration depth of o1 mm, the contact pressure of the cleaning member 411 to the photosensitive drum 1 was about 40 gf per cm.

As confirmation of an effect, the cleaning members 11 and 411 were subjected to deformation calculation, so that the contact pressure of each cleaning member was estimated. As a calculating method of the deformation calculation, friction between the photosensitive drum 1 and each of the blade portion 101 and 401 was assumed and a relationship between a deformation shape and an applied force when the end portion of the blade portion entered the photosensitive drum 1 with respect to the rotation downstream direction was calculated. Further, from the obtained forces, a component perpendicular to the surface (peripheral surface) of the photosensitive drum 1 was taken as the contact pressure, and a component parallel to the surface of the photosensitive drum 1 was taken as a frictional force. Further, a ratio between the contact pressure and the frictional force was obtained as the dynamic friction coefficient.

As the deformation calculation in this case, in consideration of neutral axes of the blade supporting member and the blade, a simple two-dimensional cantilever beam was used as a model and was subjected to the calculation.

(Assumption of Bernoulli-Euler)

Incidentally, as parameters for the calculation, a flexural rigidity $D=E/(1-\upsilon)$ of the SUS plate of 150 MPa and a longitudinal modulus E of the urethane rubber member of 6 MPa were used.

Figure 4:
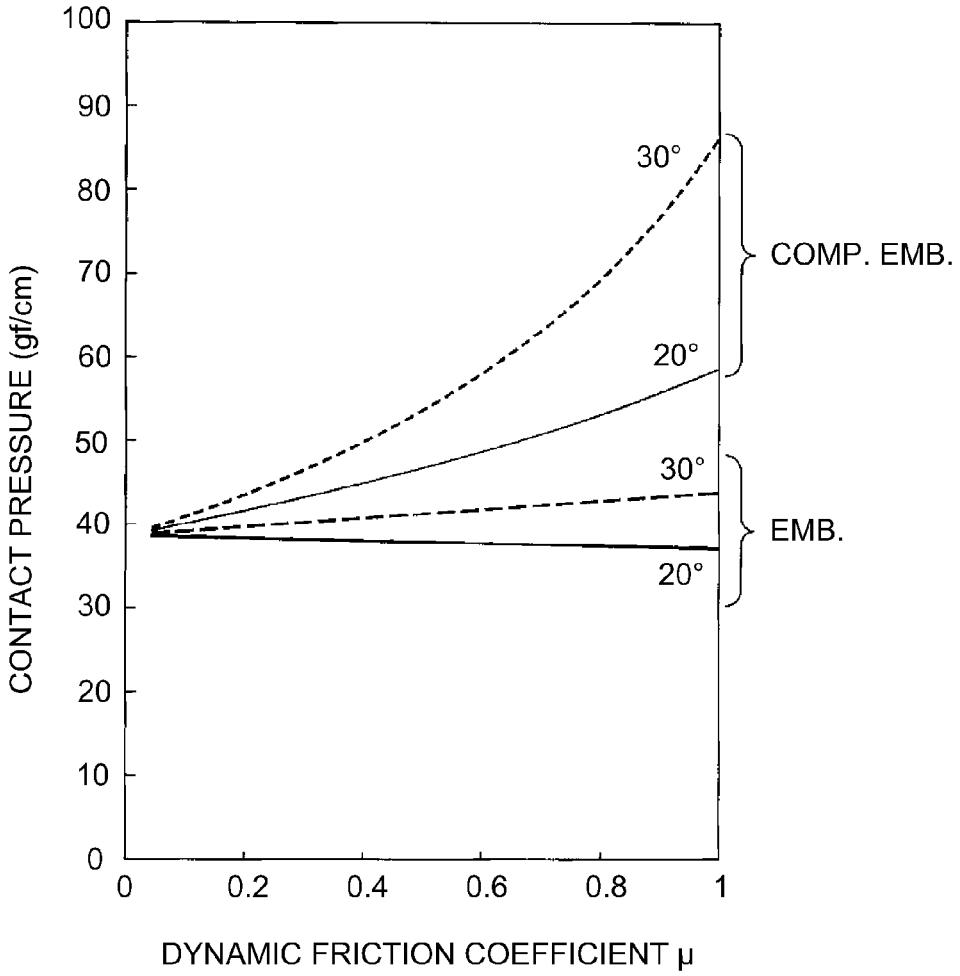
FIG. 4 is a graph showing a change in contact pressure at the blade portion.

FIG. 4 shows the results. In FIG. 4, the abscissa represents a dynamic friction coefficient μ and the ordinate represents the contact pressure (gf/cm). Thus, when compared with the cleaning member 111 having a linear structure as in Comparative Embodiment 1 ("COMP. EMB."), with respect to the cleaning member 11 in this embodiment ("EMB."), it was clear that a change in contact pressure relative to an increase in dynamic friction coefficient was small and thus the cleaning member 11 was stable. That is, as described above, even when the dynamic friction coefficient between the photosensitive drum 1 and the blade portion 101 is changed, it is possible to achieve an effect of suppressing an increase in driving torque for driving the photosensitive drum 1 and suppressing turning-up of the blade portion.

[Mounting of Cleaning Member]

A constitution for assembling the cleaning member 11 with the cleaning container 9A will be described.

Figure 5:
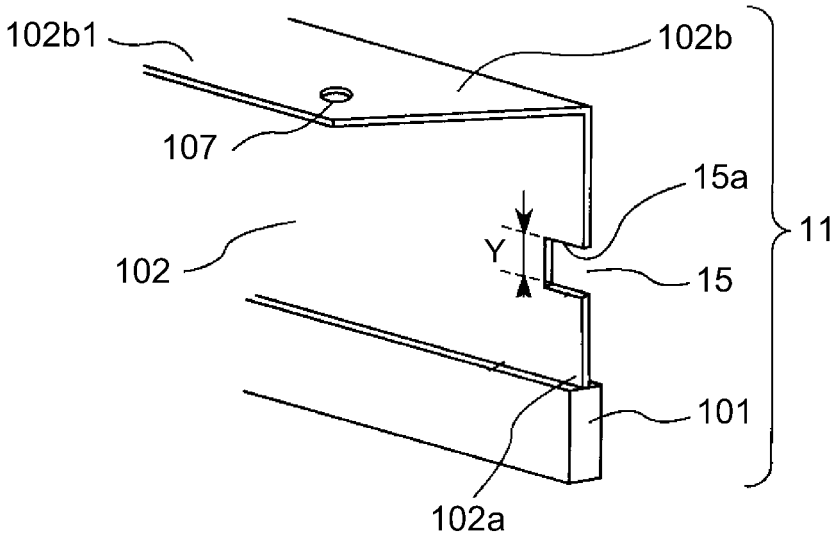
FIG. 5 is a perspective view of a positioning portion of a cleaning member.

FIG. 5 is a perspective view showing a part of the cleaning member 11 in this embodiment.

At the end portion 102*a* of the supporting member 102 where the blade portion 101 is provided, a recess 15 as a portion-to-be-engaged is provided in each of a side and another side with respect to a longitudinal direction as the axial direction of the photosensitive drum 1. The recess 15 is a cut-away portion (opening) provided at the end portion 102*a*. A hole 107 for permitting fixing of the cleaning member 11 to the cleaning container 9A (FIG. 2) is provided in the another end portion 102*b*.

In this embodiment, an upper-side surface (upper end side) 15*a* of the cut-away portion 15 constitutes a positioning portion for determining a position of the cleaning member 11 in a state in which the photosensitive drum 1 and the cleaning member 11 do not contact each other. A distance Y of the cut-away portion 15 in the up-down direction is not less than the sum of a size (thickness) T ((a) of FIG. 6) of a projection (protrusion) 20 described later as an engaging portion of the cleaning container 9A and a deformation amount of the cleaning member 11 in the S direction (FIG. 2) in which the cleaning member 11 is moved by the cleaning member 1. That is, in a state in which the blade portion 101 is contacted to the photosensitive drum 1, the projection (protrusion) 20 and the recess 15 are set so as to be placed in a spaced state with respect to the S direction (FIG. 2), and are constituted so that they do not adversely affect the contact pressure at which the blade portion 101 is contacted to the photosensitive drum 1.

Parts (a) and (b) of FIG. 6 are perspective views showing a shape of the projection 20 at the end portion of the cleaning container 9A. The projection 20 is provided no a bearing surface 21 for determining a rear-side position of the cleaning member 11 relative to the cleaning container 9A with respect to a V direction crossing the S direction (FIG. 2). When the cut-away portion 15 of the cleaning member 11 is engaged with the projection 20 in the non-contact state between the photosensitive drum 1 and the cleaning member 11, the rear-side position of the cleaning container 9A with respect to the V direction is determined by the bearing surface 21, and the position of the up-down direction as the S direction is determined by the upper surface 20*a* of the projection 20. Further, each of under a lower surface 20*b* of the projection 20 and in an upper side of the bearing surface 21, a soft sponge member 16 of, e.g., polyurethane foam is provided so as to seal between the cleaning member 11 and the cleaning container 9A, thus preventing leakage of the toner.

A perspective view of a positioning portion when the cleaning member 11 is mounted to the cleaning container 9A is shown in FIG. 7. In this embodiment, the height (thickness) T ((a) of FIG. 6) of the projection 20 is 3.0 mm. The deformation amount in which the cleaning member 11 is moved varies depending on the material, shape and size of the supporting member 20, the friction coefficient with the photosensitive drum 1, and the like, but was about 0.3 mm in the constitution in this embodiment. Therefore, the up-down direction distance Y (FIG. 5) of the cut-away portion 15 was 4.0 mm in this embodiment in view of a dimensional tolerance. Further, the upper portion 15*a* of the cut-away portion 15 of the supporting member 102 was aligned with the upper surface 20*a* as a reference surface of the projection 20, so that the position of the cleaning member 11 was determined.

Incidentally, in this embodiment, the upper surface 20*a* of the projection 20 is used as the reference surface for determining the position of the cleaning member 11 but the reference surface may also be a left surface or a right surface unless it is the lower surface 20*b*.

As described above, in the non-contact state between the photosensitive drum 1 and the cleaning member 11, after the positioning of the cleaning member 11 is made, the cleaning member 11 is fixed by screwing or the like at a free end-side hole 107 of a L-shaped portion of the supporting member 102. That is, the hole 107 is configured to have a size which permits the screwing even when the position of the cleaning member 11 is determined by the projection 20 and bearing surface 21 of the cleaning container 9A. Thereafter, when the photosensitive drum 1 and the cleaning member 11 are contacted to each other, the penetration depth H of the blade portion 101 into the photosensitive drum 1 is stabilized, so that also the contact pressure is stabilized.

For example, as Comparative Embodiment 2, states each in which a cleaning member 202 or 302 is positioned in cleaning devices 209 and 309 are shown in (a) to (d) of FIG. 9. That is, as shown in (a) and (b) of FIG. 9, a developing recess 215 provided in the neighborhood of a supporting member downstream portion 202*b* is engaged with a positioning projection 220 of a holding member 209A1 and then the cleaning member 202 is fixed with a screw 106 through hole 207. In this case, another end portion (downstream side) 202*b* of the cleaning member 202 is fixed to a cleaning container 209A. As a result, a distance from the positioning projection 220 to the contact portion where the cleaning member 202 contacts the photosensitive drum 1 is large, and a bent portion 202*c* is provided, so that it is difficult to determine the position of the blade portion 201 attached to end portion 202*a* with high accuracy.

Further, as shown in (c) and (d) of FIG. 9, a holding member 309A1 is provided, and positioning is made at an end portion 302*a* of a supporting member 302, so that assembling is easily effected and also positional accuracy of the blade portion 301 is readily ensured. That is, a positioning projection 320 is provided on the holding member 309A1, and a positioning recess 315 is provided in the neighborhood of a bent portion 302*c* of the supporting member 302. Then, the projection 320 is engaged with the recess 315 at the end portion 302*a* of the supporting member 302 to effect the positioning. Then, at another end portion 302*b*, the supporting member 302 is fixed to a fixing portion 309A2 of cleaning container 309A with a screw 106 (using hole 307) or the like.

However, according to an assembling method as shown in (c) and (d) of FIG. 9, even when the photosensitive drum 1 is driven to generate a force acting in the arrow S direction, the projection 320 and the cut-away portion 315 are engaged with each other with no clearance with respect to the arrow S direction and therefore deformation of the cleaning member 311 is prevented. That is, the cleaning member 11 is placed in a situation similar to that (FIG. 10) in Comparative Embodiment 1.

As described above, by effecting the positioning of the cleaning member 11 as in Embodiment 1, it is possible to easily effect assembling of the blade portion 101 of the cleaning member 11 with high positional accuracy. The contact pressure of the cleaning member 11 is stabilized and therefore even when the supporting member 102 is deformed, the deformation is not prevented, so that it was possible to maintain a good cleaning performance.

In this embodiment, the constitution in which the cut-away portion 15 of the supporting member 102 has a rectangular shape and is provided in each of the end side and another end side of the supporting member 102 with respect to the longitudinal direction of the supporting member 102 is described but the shape of the cut-away portion is not limited to the rectangular shape. For example, the shape may also be an elongated hole shape as shown in (a) of FIG. 8. Further, as shown in (b) of FIG. 8, the positioning portion shape of the cleaning member 11 may be the projected shape, and a corresponding shape of the cleaning container end portion may be the recessed shape (cut-away shape or the like).

As described above, the shape of the positioning portion between the cleaning member and the cleaning container is constituted as in the direction, so that it was possible to realize easy assembling and easy ensuring of the positional accuracy and was also possible to maintain the cleaning member characteristic, so that the cleaning performance was capable of being maintained at a stable contact pressure.

In this embodiment, the monochromatic image forming apparatus is described, but a multi-color image forming apparatus may also be used if a similar cleaning device is used in the image forming apparatus. Further, in this embodiment, the image forming apparatus using no intermediary transfer member described but an image forming apparatus of an intermediary transfer type may also be used.

According to the present invention, the increase in torque and the turning-up of the blade portion when the image bearing member is driven can be suppressed. Further, the cleaning member can be easily assembled with the frame, so that the positional accuracy of the blade portion relative to the image bearing member is readily ensured. For that reason, it is possible to maintain the stable cleaning property.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 033748/2012 filed Feb. 20, 2012, which is hereby incorporated by reference.

What is claimed is:

1. A cleaning device for use with an image forming apparatus, comprising:

a frame including a fixing portion;

a cleaning member, fixed at the fixing portion, for removing a developer from an image bearing member, wherein said cleaning member includes: a blade portion contacted to the image bearing member with respect to a counter direction to a movement direction of the image bearing member; and a flexible supporting member for supporting said blade portion, said supporting member including one end portion where said blade portion is provided, another end portion including a portion-to-be-fixed for being fixed at the fixing portion, and a bent portion between said one end portion and said another end portion at a side remote from a surface of the image bearing member toward an outside with respect to a line connecting the portion-to-be-fixed and a contact portion where said blade portion is contacted to the image bearing member, wherein the portion-to-be-fixed is provided downstream of the contact portion with respect to movement direction of the image bearing member; and an engaging portion provided on said frame, wherein said engaging portion is engaged, in a state in which said blade portion is not contacted to the image bearing member, with a portion-to-be-engaged provided at said supporting member to position said cleaning member, and wherein said engaging portion is spaced from said portion-to-be-engaged in a state in which said blade portion is contacted to the image bearing member.

2. A cleaning device according to claim 1, wherein said portion-to-be-engaged is an opening provided at said supporting member, and said engaging portion is a projection which enters said opening, and wherein a size of said opening is larger than a size of said engaging portion with respect to a movement direction of said supporting member moved by being urged by the image bearing member.

3. A cleaning device according to claim 1, wherein said portion-to-be-engaged is a projection provided at said supporting member, and said engaging portion is an opening, wherein said projection enters said opening, and wherein a size of said opening is larger than a size of said portion-to-be-engaged with respect to a movement direction of said supporting member moved by being urged by the image bearing member.

4. A cleaning device according to claim 1, wherein said portion-to-be-engaged is provided between said bent portion and said blade portion.

5. A cleaning device according to claim 1, wherein said portion-to-be-engaged is provided at said supporting member at each of a side and another side with respect to a longitudinal direction of said blade portion.

6. A cleaning device according to claim 1, wherein said flexible supporting member comprises a spring.

7. A process cartridge detachably mountable to an image forming apparatus, comprising:

(i) an image bearing member;

(ii) a frame including a fixing portion;

(iii) a cleaning member, fixed at the fixing portion, for removing a developer from said image bearing member, wherein said cleaning member includes: a blade portion contacted to said image bearing member with respect to a counter direction to a movement direction of said image bearing member; and a flexible supporting member for supporting said blade portion, said supporting member including one end portion where said blade portion is provided, another end portion including a portion-to-be-fixed for being fixed at the fixing portion, and a bent portion between said one end portion and said another end portion at a side remote from a surface of said image bearing member toward an outside with respect to a line connecting the portion-to-be-fixed and a contact portion where said blade portion is contacted to said image bearing member, wherein the portion-to-be-fixed is provided downstream of the contact portion with respect to movement direction of said image bearing member; and (iv) an engaging portion provided on said frame, wherein said engaging portion is engaged, in a state in which said blade portion is not contacted to the image bearing member, with a portion-to-be-engaged provided at said supporting member to position said cleaning member, and wherein said engaging portion is spaced from said portion-to-be-engaged in a state in which said blade portion is contacted to the image bearing member.

8. A process cartridge according to claim 7, wherein said portion-to-be-engaged is an opening provided at said supporting member, and said engaging portion is a projection which enters said opening, and wherein a size of said opening is larger than a size of said engaging portion with respect to a movement direction of said supporting member moved by being urged by the image bearing member.

9. A process cartridge according to claim 7, wherein said portion-to-be-engaged is a projection provided at said supporting member, and said engaging portion is an opening, wherein said projection enters said opening, and wherein a size of said opening is larger than a size of said portion-to-be-engaged with respect to a movement direction of said supporting member moved by being urged by the image bearing member.

10. A process cartridge according to claim 7, wherein said portion-to-be-engaged is provided between said bent portion and said blade portion.

11. A process cartridge according to claim 7, wherein said portion-to-be-engaged is provided at said supporting member at each of a side and another side with respect to a longitudinal direction of said blade portion.

12. An image forming apparatus for forming an image on a recording material, comprising:

(i) an image bearing member;

(ii) a frame including a fixing portion;

(iii) a cleaning member, fixed at the fixing portion, for removing a developer from said image bearing member, wherein said cleaning member includes: a blade portion contacted to said image bearing member with respect to a counter direction to a movement direction of said image bearing member; and a flexible supporting member for supporting said blade portion, said supporting member including one end portion where said blade portion is provided, another end portion including a portion-to-be-fixed for being fixed at the fixing portion, and a bent portion between said one end portion and said another end portion at a side remote from a surface of said image bearing member toward an outside with respect to a line connecting the portion-to-be-fixed and a contact portion where said blade portion is contacted to said image bearing member, wherein the portion-to-be-fixed is provided downstream of the contact portion with respect to movement direction of said image bearing member; and (iv) an engaging portion provided on said frame, wherein said engaging portion is engaged, in a state in which said blade portion is not contacted to the image bearing member, with a portion-to-be-engaged provided at said supporting member to position said cleaning member, and wherein said engaging portion is spaced from said portion-to-be-engaged in a state in which said blade portion is contacted to the image bearing member.

13. An image forming apparatus according to claim 12, wherein said portion-to-be-engaged is an opening provided at said supporting member, and said engaging portion is a projection which enters said opening, and wherein a size of said opening is larger than a size of said engaging portion with respect to a movement direction of said supporting member moved by being urged by the image bearing member.

14. An image forming apparatus according to claim 12, wherein said portion-to-be-engaged is a projection provided at said supporting member, and said engaging portion is an opening, wherein said projection enters said opening, and wherein a size of said opening is larger than a size of said portion-to-be-engaged with respect to a movement direction of said supporting member moved by being urged by the image bearing member.

15. An image forming apparatus according to claim 12, wherein said portion-to-be-engaged is provided between said bent portion and said blade portion.

16. An image forming apparatus according to claim 12, wherein said portion-to-be-engaged is provided at said supporting member at each of a side and another side with respect to a longitudinal direction of said blade portion.

17. A cleaning device comprising:

a frame including a fixing portion;

a cleaning member, fixed at the fixing portion, for removing a developer from an image bearing member, wherein said cleaning member includes: a blade portion contacted to the image bearing member; and a supporting member for supporting said blade portion, said supporting member including one end portion where said blade portion is provided, another end portion including a portion-to-be-fixed for being fixed at the fixing portion, and a bent portion between said one end portion and said another end portion; and an engaging portion provided on said frame, wherein said engaging portion is engaged, in a state in which said blade portion is not contacted to the image bearing member, with a portion-to-be-engaged provided at said supporting member to position said cleaning member, and wherein said engaging portion is spaced from said portion-to-be-engaged in a state in which said blade portion is contacted to the image bearing member.

18. A cleaning device according to claim 17, wherein said supporting member comprises a spring.

19. A cleaning device comprising:

a frame including a fixing portion and a projection; and a cleaning member, fixed at the fixing portion, for removing a developer from an image bearing member, wherein said cleaning member includes: a blade portion contacted to the image bearing member; and a supporting member for supporting said blade portion, said supporting member including one end portion where said blade portion is provided, another end portion including a portion-to-be-fixed for being fixed at the fixing portion, a bent portion between said one end portion and said another end portion and a cut-away portion, wherein said projection is spaced from said cut-away portion in a state in which said blade portion is contacted to the image bearing member, and wherein said cut-away portion is used for determining a position of said cleaning member.

20. A cleaning device comprising:

a frame including a fixing portion and a cut-away portion; and a cleaning member, fixed at the fixing portion, for removing a developer from an image bearing member, wherein said cleaning member includes: a blade portion contacted to the image bearing member; and a supporting member for supporting said blade portion, said supporting member including one end portion where said blade portion is provided, another end portion including a portion-to-be-fixed for being fixed at the fixing portion, a bent portion between said one end portion and said another end portion and a projection, wherein said projection is spaced from said cut-away portion in a state in which said blade portion is contacted to the image bearing member.

21. A cleaning device according to claim 20, wherein said cut-away portion is used for determining a position of said cleaning member.

* * * * *